United States Patent [19]

Ritt

[11] Patent Number: 4,763,102

[45] Date of Patent: Aug. 9, 1988

[54] CARTRIDGE HEATER

[75] Inventor: Robert A. Ritt, Palatine, Ill.

[73] Assignee: Acra Electric Corporation, Schiller Park, Ill.

[21] Appl. No.: 8,465

[22] Filed: Jan. 29, 1987

[51] Int. Cl.[4] ..... H01C 1/03

[52] U.S. Cl. ..... 338/240; 219/544; 219/541; 338/295

[58] Field of Search ..... 338/240, 249, 254, 264, 338/265, 266, 270–279, 301, 295; 219/541, 544, 546, 548

[56] References Cited

U.S. PATENT DOCUMENTS

| | | | |
|---|---|---|---|
| 2,522,724 | 9/1950 | Scharf | 338/301 X |
| 2,761,042 | 8/1956 | Scott | 338/301 |
| 3,210,714 | 10/1965 | Hummel | 338/301 |
| 3,307,135 | 2/1967 | Simmons | 338/274 X |
| 3,310,769 | 3/1967 | Simmons | 338/274 X |
| 3,622,935 | 11/1971 | Oakley | 338/238 X |
| 3,668,598 | 6/1972 | Drugmand et al. | 338/274 |
| 3,812,580 | 5/1974 | Drugmand | 338/238 X |
| 3,813,771 | 6/1974 | Skogland | 338/238 X |
| 4,034,330 | 7/1977 | Goto | 338/238 |
| 4,039,995 | 8/1977 | Walton et al. | 338/295 |
| 4,039,996 | 8/1977 | Handerhan | 338/295 |

*Primary Examiner*—E. A. Goldberg
*Assistant Examiner*—Marvin M. Lateef
*Attorney, Agent, or Firm*—Wood, Dalton, Phillips, Mason & Rowe

[57] ABSTRACT

An electrical cartridge heater includes a flat rectangular core of mica. A resistance wire is helically wound around the mica core. A cover sheet of mica is placed on one face of the wound core so that a return wire extends back without shorting against the other wires. The mica core is received in recesses in head and slug end bushings to position the element centrally within a cylindrical shell. A granular fill surrounds the core and heating element within the shell.

24 Claims, 1 Drawing Sheet

CARTRIDGE HEATER

FIELD OF THE INVENTION

This invention relates to an electrical heating element and more particularly to a cartridge heater having a mica core.

BACKGROUND OF THE INVENTION

Prior art cartridge heaters, such as is shown in Drugmand U.S. Pat. No. 3,812,580, use a resistance conductor wound about an extruded ceramic core. The ends of the resistance wire extend into longitudinal openings in the core, wherein each makes electrical contact with a bare multi-strand conductor which has been inserted through the openings. The multi-strand conductors exit the core at one end thereby defining terminal ends. This assembly is inserted in the tubular metal sheath with appropriate centering bushings and powdered refractory material. The sheath is then swaged to compact the refracting material.

A similar cartridge heater construction is shown in Simmons U.S. Pat. No. 3,310,769 wherein a core is formed of compacted magnesium oxide. The Simmons cartridge heater assembly is swaged to provide a high density heating element which results in greater heat output.

The cores of the above two patents, are of cylindrical construction and, as described above, have longitudinal openings therethrough for terminating ends of the resistance wire. Such a ceramic core is relatively expensive to produce, thus increasing the total cost of the cartridge heater.

In view of the above, it is desirable to have a cartridge heater with a core which is inexpensive and simple to produce.

SUMMARY OF THE INVENTION

It is an object of this invention to provide a cartridge heater utilizing an inexpensive core for carrying a heating element.

In accordance with this invention, the cartridge heater includes a cylindrical metal shell having first and second ends. First and second bushings, one in each end of the shell, have facing surfaces with complementary slotted recesses therein. The first bushing also includes a pair of longitudinal apertures therethrough. The apertures are utilized for electrical terminals. The second busing further includes a fill slot formed therein. A core has ends which are received in the recesses to support the core within the shell. An electric heating element is wound about the core and has two ends which are coupled to electrical conductors which extend outwardly from said apertures. A granular filler surrounds the core and heating element and closes off the fill slot. A metal end cap is secured to the shell at the second end outside of the second bushing and retains the granular fill within the shell. An epoxy seal may be provided at the first end of the shell over the first bushing to provide a seal.

Another feature of this invention is that a core cover is provided over the wound core. A return lead couples one end of the electrical heating element to the conductor and extends therebetween outwardly of the cover without shorting against the windings of the heating element.

A further feature of this invention is the utilization of flat rectangular core carried by the recesses in the bushings. The core cover is similarly of a flat rectangular construction.

Yet another feature is the use of a mica splitting or a mica paper for the core.

Further features and advantages of this invention will readily be apparent from the specification and from the drawings.

DESCRIPTION OF THE INVENTION

Figure 1:
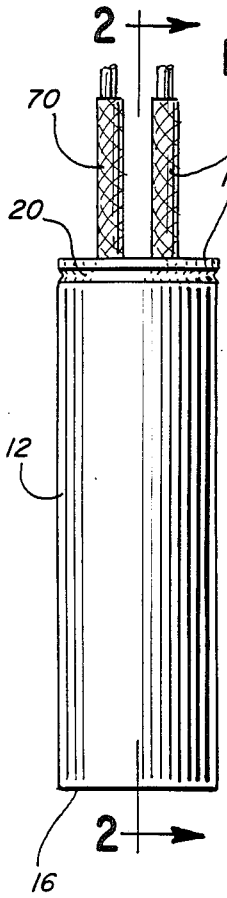
FIG. 1 is an elevation illustrating a cartridge heater according to the present invention.
Figure 2:
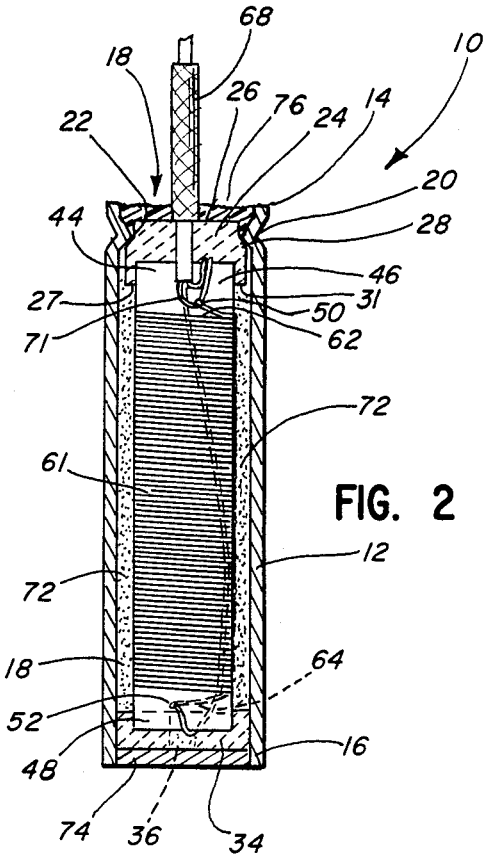
FIG. 2 is a sectional view of the cartridge heater taken along the lines 2—2 of FIG. 1.
Figure 3:
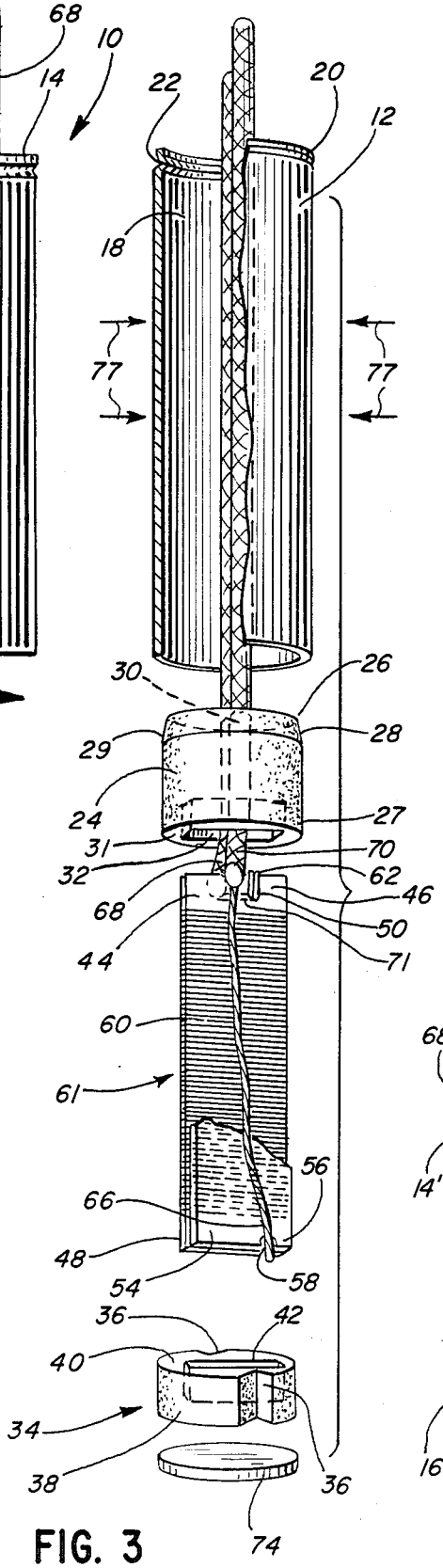
FIG. 3 is an exploded view of the cartridge heater of FIG. 1 with a portion of the core cover broken away.

Referring to FIGS. 1–3, a cartridge heater 10 according to the invention includes a cylindrical shell 12. The shell 12 has an open first or head end 14 and an open second or slug end 16 defining an inner hollow space 18. The shell 12 is of, for example, brass or stainless steel. A radial indentation 20 in the shell 12 adjacent the head end defines an inwardly extending rib 22.

A centralizing head bushing 24 is located in the inner space 18 of the shell 12 at the head end 14 thereof. The first bushing 24 is of, for example, ceramic. The first bushing 24 is of generally cylindrical shape and includes an outer end 26 of narrower radius than an inner end 27 defining a shoulder 28. The shoulder 28 has a radius larger than the inner radius defined by the rib 22 of the shell 12 so that the shoulder 28 engages the rib 22 to retain and center the head bushing 24 in the shell 12. A pair of apertures 29 and 30 extend longitudinally through the head bushing 24. The inner end 27 of the head bushing 24 has an inner face 31 with a slotted recess 32 therein.

A slug bushing 34 is located in the shell 12 at the slug end 16 thereof. The slug bushing 34 is of, for example, ceramic. The slug bushing 34 is of generally cylindrical shape and includes a pair of fill slots 36 notched in its outer peripheral wall 38. The slug bushing 34 has an inner face 40 which faces the inner face 31 of the head bushing 24. An inwardly opening slotted recess 42 opens through the inner face 40.

The slotted recess 32 of the head bushing 24 and the slotted recess 42 of the slug bushing 34 are of a similar size and shape defining complementary facing recesses.

A flat rectangular core 44 has a first end 46 and a second end 48. A first aperture 50 extends through the core 44 at the first end 46 thereof. A second aperture 52 extends through the core 48 at the second 44 thereof.

A flat rectangular core cover 54 is of similar size to the core 44. The cover 54 includes a first end (not shown) and a second end 56. A notch 58 is provided at the second end 56 of the cover 54.

The core 44 and cover 54 are preferably made of mica which is relatively inexpensive as compared to ceramic. The core may be of mica splitting or of mica paper which is a commercial product made from a slurry of mica particles with a silicon resin binder. Alternatively, the core may be made of ceramic or lava or other similar materials as will be obvious to those skilled in the art. Similarly, according to this invention, the core need not be of flat rectangular shape. Instead, the core could be shaped as a rod or other similar shape. The shape of the cover would then be determined n accordance with the shape of the core.

The slotted recesses 32 and 42 in the bushings 24 and 34 are sized so as to be slightly larger than the core 44 and cover 54 when these latter two elements are sandwiched together. The ends or the core 44 and cover 54 are received by the slotted recesses 32 and 42 to position the cover 44 and cover 54 centrally with respect to the shell 12.

A resistive heating element 60 is helically wound around the core 44 defining a wound core 61. A first end turn 62 of the heating element 60 extends through the aperture 50 and is looped around the end 46. A second end turn 64 of the heating element 60 extends through the aperture 52 and is similarly looped around the end 48 of the core 44. Thus, the heating element 60 and core 44 are maintained in assembled relation.

The cover 54 is placed on one face of the wound core 61 in a sandwich-like construction. A return lead 66 is electrically coupled to the second end turn 64 of the heating element 60. The return lead lodges in the notch 58 of the cover 54 and extends back to the first end of the cover 54 on a side of the cover 54 remote from the wound core 61 so that the return wire does not short against the windings of the heating element 60. The wound core 61 with its associated cover 54 is received in the slotted recesses 32 and 42 to support the wound core 61 and cover 54 within the shell 12.

First and second electrical terminals 68 and 70 are disposed within the apertures 29 and 30, respectively, of the head bushing 24, and extend outwardly thereform. A conductor 71, which may be part of the heating element 60, electrically couples the first end turn 62 of the heating element 62 to the first terminal 68. The return lead 66, which may also be part of the heating element 60, is electrically coupled to the second terminal 70. The terminals 68 and 70 may be, for example, multistrand conductors or terminal pins, which may be threaded.

A granular filler of, for example, magnesium oxide 72 surround the wound core 61. The granular filler 72 also fills the slots 36 in the slug bushing 34.

A slug end piece or cap 74 may be of, for example, brass or stainless steel. The cap 74 is placed over the slug bushing 34 and brazed to the shell 12 at the slug end 16 thereof.

The head end 14 of the shell may be potted with epoxy 76 to provide a seal between the shell 12 and the head bushing 24.

Referring particularly to FIG. 3, a method of assembling the cartridge heater of this invention will be described. The wound core 61 with its associated cover 54 are sandwiched together with the terminals 68 and 70 electrically coupled to the heating element as described above. The terminals 68 and 70 are inserted through the openings 29 and 30, respectively, of the head busing 24 until the first ends of the wound core 61 and cover 54 extend into the inwardly opening slotted recess 32 of the head bushing 24. The slug bushing 34 is placed to receive the second ends of the wound core 61 and cover 54 in the recess 42 therein. The busings 24 and 34 and wound core assembly are then inserted through the slug end of the bushing until the shoulder 28 of the head bushing 24 engages the rib 22 at the head end 14 of the shell 12. The granular filler 72 is then introduced into the shell 12 through the fill slots 36 in the slug bushing 34. The slug end piece 74 is placed over the slug bushing 34 and is brazed to the shell 12. If necessary the epoxy seal 76 is provided at the head end 14.

The cartridge heater as described is intended for intermediate wattage loadings up to 20 watts per square inch. Where higher wattage loading is desired, a similarly constructed cartridge type heater may be swaged by applying compressive forces, indicated by arrows 77, to the shell 12 to provide higher wattage ratings.

Figure 4:
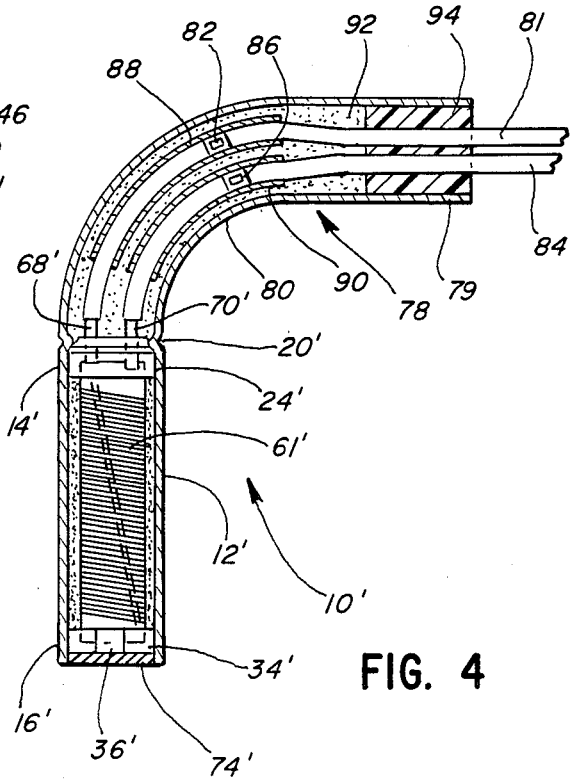
FIG. 4 is a sectional view similar to that in FIG. 2, of an alternate embodiment of the cartridge heater.

An alternative embodiment of the invention is illustrated in FIG. 4 wherein primed reference numerals reference elements corresponding with elements previously discussed with reference to FIGS. 1–3.

In the alternate embodiment, the cartridge heater 10' includes a curved extension portion 78. The shell 12' is elongated and has a distal end 79 so that the head end 14' is intermediate the distal end 79 and the slug end 16. The shell 12' includes a turned portion 80 between the head end 14' and the distal end 79. The shell 12' is turned as such to allow for different orientations of the cartridge heater. The shell 12' may be bent to different angles.

The conductor 68' is electrically coupled to a wire 81 at a connector 82. Similarly, the conductor 70' is electrically coupled to a wire 84 at connector 86. The connectors 82 and 86 may be, for example, crimpable splice connectors. Insulation sleeves 88 and 90 insulate the connections at connectors 82 and 86, respectively. The wires 81 and 84 extend outwardly from the distal end 79 of the shell 12' to provide for electrical connection to a source of electrical power.

A granular fill 92 of, for example, magnesium oxide, fills the extended portion 78 of the heater. An epoxy seal 94 provides a seal at the distal end 79 of the shell extension 78.

As described above, a cartridge heater according to the invention is simple and inexpensive to produce.

I claim:

1. A cartridge heater comprising:

a cylindrical shell having first and second ends;

first and second bushings, one in each end of said shell, the bushings having facing surfaces with complementary slotted recesses therein;

a flat rectangular core with ends received in said recesses to support the core within the shell; and an electric heating element carried by said core.

2. The cartridge heater of claim 1 wherein said shell has an inwardly extending rib at one end and the bushing at said one end has a shoulder engaging the rib to retain and center the bushing in the shell.

3. The cartridge heater of claim 1 further comprising a slug end piece secured to said shell at one end over the bushing at said one end.

4. A cartridge heater comprising:

a cylindrical shell having first and second ends;

a first bushing within said shell at said first end thereof, said first bushing having an inwardly opening slotted recess and a pair of apertures extending longitudinally therethrough;

a second bushing within said shell adjacent said second end thereof, said second bushing having an inwardly opening slotted recess opposite the recess in said first bushing and a longitudinally extending fill slot therethrough;

a core having ends received in said recesses to support the core within said shell;

a resistive conductor wound about said core said conductor element having ends which extend into said apertures in said first bushing;

first and second terminals electrically connected to said conductor ends within said apertures, said terminals extending outwardly from said first bushing defining electrical terminations for said cartridge heater; and a granular filler surrounding the core and conductor within said shell and filling the slot in said second bushing.

5. The cartridge heater of claim 4 wherein said bushings are ceramic.

6. The cartridge heater of claim 4 wherein said core is of flat rectangular shape.

7. The cartridge heater of claim 4 wherein said shell has in inwardly extending rib at said first end and said first bushing has a shoulder engaging the rib to retain and center the first bushing in the shell.

8. The cartridge heater of claim 4 further comprising an end cap secured to said shell at said second end over said second bushing.

9. A cartridge heating element comprising:

a hollow metal shell having a head end and a slug end;

a head bushing within said shell at said head end thereof, said head bushing having an inwardly opening slotted recess and a pair of apertures extending longitudinally therethrough;

a slug bushing within said shell at said slug end thereof, having an inwardly opening slotted recess opposite said recess of said head bushing;

a pair of electrical conductors one extending outwardly from each of said apertures of said head bushing;

a core disposed within said shell, said core having first and second ends received in said recesses;

a resistive heating element wound about said core defining a wound core having first and second end turns at said first and second ends of said core, respectively;

means for coupling said first end turn to one of said conductors;

a core cover extending parallel to said wound core and being carried by said recesses;

a conductive return lead electrically coupling said second end turn of said wound core and said other of said conductors, said conductor extending therebetween on a side of said cover remote from said wound core so that said conductor is spaced from the windings of said heating element.

10. The cartridge heating element of claim 9 wherein said core is a flat rectangular shape.

11. The cartridge heating element of claim 9 wherein said cover is of flat rectangular shape.

12. The cartridge heating element of claim 10 wherein said core is a mica splitting.

13. The cartridge heating element of claim 10 wherein said core is of mica paper.

14. The cartridge heating element of claim 9 wherein said core is ceramic.

15. The cartridge heating element of claim 9 wherein said core is lava.

16. The cartridge heating element of claim 9 wherein said bushings are ceramic.

17. The cartridge heating element of claim 9 wherein said conductors comprise terminal pins.

18. The cartridge heating element of claim 9 further comprising a metal slug end piece secured to said shell at said slug end.

19. The cartridge heating element of claim 9 further comprising means for sealing said shell at said head end over said head bushing.

20. The cartridge heating element of claim 9 wherein said shell extends angularly from said head end to a distal end remote from said slug end, and said electrical conductors extend through the shell to said distal end.

21. A method of assembling a cartridge heater comprising the steps of:

winding a resistive electrical conductor having first and second ends about a core to provide a wound core;

extend said first and second ends through a first bushing having first and second apertures therethrough;

placing said first bushing having a slotted recess therein over one end of said wound core;

placing a second bushing having a slotted recess therein and a slot therethrough over another end of said wound core;

inserting said core and said bushings in a cylindrical shell having first and second ends with a shoulder of said first bushing engaging an inwardly extending rib in said first end of said shell;

filling said shell with a granular fill using said fill slot in said second bushing; and placing a slug end piece over said second bushing and securing it to said shell.

22. The method of claim 21 further comprising the step of placing a core cover over a portion of said core after said conductor is wound thereon.

23. The method of claim 21 further comprising the step of swaging said cartridge.

24. The method of claim 21 further comprising the step of sealing said first end of said shell over said first bushing.

* * * * *